United States Patent [19]

Zimmern

[11] Patent Number: 4,691,533

[45] Date of Patent: Sep. 8, 1987

[54] REFRIGERATION SYSTEM WITH A CENTRIFUGAL ECONOMIZER

[76] Inventor: Bernard Zimmern, 6 New St., East Norwalk, Conn. 06855

[21] Appl. No.: 907,080

[22] Filed: Sep. 15, 1986

[30] Foreign Application Priority Data

Sep. 27, 1985 [FR] France ..... 85 14337

[51] Int. Cl.[4] ..... F25B 43/00

[52] U.S. Cl. ..... 62/512; 62/500; 62/509

[58] Field of Search ..... 62/514 R, 509, 500, 62/5, 512, 503

[56] References Cited

U.S. PATENT DOCUMENTS 4,509,341 4/1985 Zimmern .

FOREIGN PATENT DOCUMENTS 2541437 8/1984 France .

2037965 12/1978 United Kingdom .

*Primary Examiner*—Henry A. Bennet

*Attorney, Agent, or Firm*—Robert F. Ziems

[57] ABSTRACT

In a refrigeration system, a centrifugal economizer discharges liquid towards an evaporator through a wholly static restriction (17), the dimension of which is chosen so as to allow no gas or little gas to escape with the liquid at the conditions of maximum pressure ratio in permanent operation. When the pressure ratio is lower, the flow rate allowed by the restriction tends to decrease with respect to the flow rate delivered by the compressor. This entails an increase in the radial thickness of the liquid ring in the centrifugal device. This in turn increases the pressure upstream of the restriction, whereby compensating the initial tendency of the flow rate to decrease through the restriction.

1 Claim, 3 Drawing Figures

REFRIGERATION SYSTEM WITH A CENTRIFUGAL ECONOMIZER

BACKGROUND OF THE INVENTION

1. Field of the Invention

This invention relates to a refrigeration system with a centrifugal economiser.

2. Description of the Prior Art

French Patent No. 2.541.437 discloses a centrifugal economiser for a refrigeration or the like (heat pump, etc.) system.

As is well known, in a circuit comprising an economiser, part of the gas produced by the expansion valve is returned to the compressor at a pressure intermediate between the intake and discharge pressures, thereby to increase by the same amount the quantity of "useful" gas taken in by the compressor and to improve its capacity as well as its thermodynamic efficiency.

In the abovementioned patent separation of the liquid sent to the evaporator from the gas going towards the economiser orifice is performed by a rotor, rotating in a stationary casing. The gas exits generally near the axis of rotation of the rotor and the liquid at the periphery ; appropriate means ensure that no gas leaves with the liquid, so as to fully enjoy the advantages of the device. This is obtained by controlling the liquid flow by a valve, which opens and closes as a function of the thickness of the liquid ring continuously formed around the rotor.

It has nevertheless been noticed that this device has drawbacks. First, though simple, said valve costs a certain amount. But moreover, if for any reason, say a chip, the valve jams, the centrifugal separator no longer operates : either the valve is too open, and a major part of the gas goes to the evaporator, or it remained too closed whereby a great portion of the produced liquid is sent uselessly to the compressor.

SUMMARY OF THE INVENTION

This invention relates to a refrigeration or the like system provided with an economiser and comprising at least a compressor having a discharge orifice connected to a condenser communicating with an expansion valve connected to a centrifugal economiser, the latter being connected via a gas conduit to an economiser orifice of the compressor and via a liquid conduit to an evaporator connected to an intake orifice of said compressor, the centrifugal economiser comprising a rotor mounted for rotation in a stationary casing provided with three orifices respectively connected to the expansion valve, to the economiser orifice and to the evaporator, and wherein the liquid conduit has a restriction the section of which is chosen so that, for the highest pressure ratios sustained by the system during permanent operation, the flow of gas through the liquid conduit does not exceed substantially 20% of the flow of gas returning to the economiser orifice.

It has indeed been noticed that the known control valve can be replaced with a mere restriction having an appropriate cross-section, while achieving practically the same result, i.e liquid and liquid only -even if under extreme conditions, some gas may, if desired, accompany the liquid-exits through the liquid orifice, and this under all pressure conditions of the compressor ; and at the same time, the centrifuge does not foul and does not let significant quantities of liquid leave with the gas.

Being static, a restriction cannot get jammed and thus the system reliability, not to speak of its cost, is greatly improved.

DESCRIPTION OF THE PREFERRED EMBODIMENT

Figure 1:
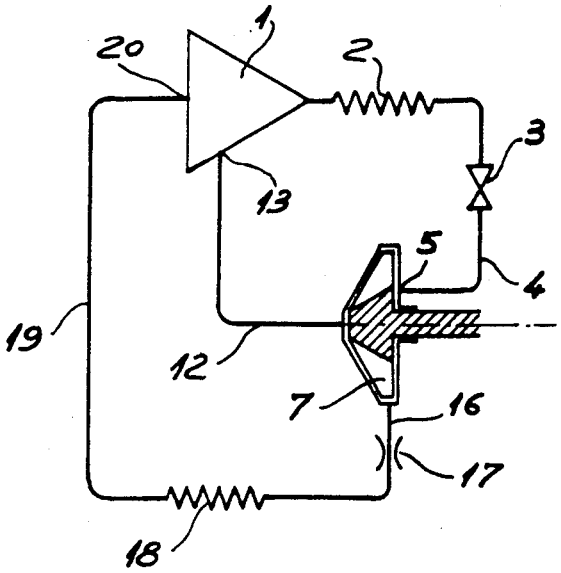
FIG. 1 is a diagram of a refrigerating circuit according to the invention
Figure 2:
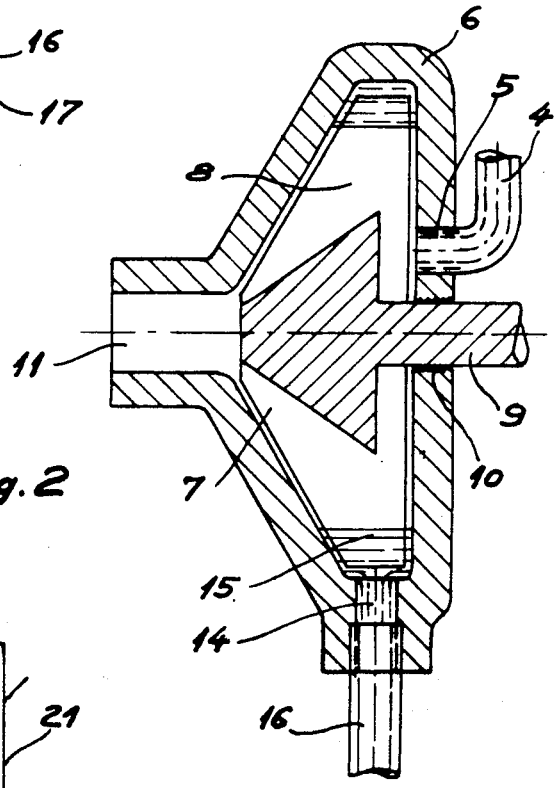
FIG. 2 is a sectional view of the centrifugal economiser used in FIG. 1

As shown in FIGS. 1 and 2, a refrigeration system comprises a compressor 1 discharging into a condenser 2 connected to an expansion valve 3 connected by a conduit 4 to an injection orifice 5 for the liquid-gas mixture produced at the expansion valve. Said orifice 5 is provided through the casing 6 of a centrifugal economiser 7 comprised of a rotor provided with blades 8 or any equivalent means to rotate the gas liquid mixture entering the casing. The rotor is mounted on and rotates with a shaft 9 rotatably driven by means not shown ; sealing means, such as e.g. a labyrinth, are provided in 10 around the shaft 9.

The separated gas escapes through an orifice 11 and a conduit 12 towards a hole 13 provided through the compressor casing, at a position intermediate between the intake orifice 20 and the discharge orifice. An orifice 14 provided through the casing 6 allows exit of the liquid which, in operation, tends to form a liquid ring, shown at 15, around the rotor and directs the liquid via a conduit 16 through a restriction 17 towards the evaporator 18. The latter is in turn connected, via a conduit 19, to the intake 20 of the compressor.

The restriction 17 is dimensioned as follows.

Figure 3:
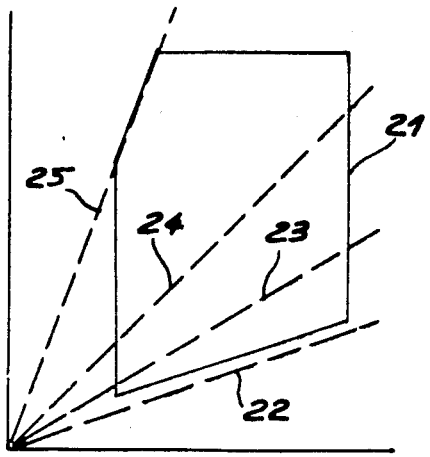
FIG. 3 is a diagram of the pressures under which the compressor operates and the zone of conditions that determine the section of the restriction.

By reference to FIG. 3, the abscissae represent the intake pressures the compressor may encounter in operation, and the ordinates the discharge pressures. A polygon 21 shows the extreme conditions the compressor may encounter, and all operating cases are thus located inside this polygon.

Straight lines 22, 23, 24 and 25 illustrate the operating conditions for respective constant pressure ratios between intake and discharge.

It has been noticed according to the invention, that in a restriction subject on one side to the economiser pressure and on the other side to the intake pressure, the flow rate, which varies according to these conditions, remains generally in a constant proportion with the mass flow taken in by the compressor for a given compression ratio.

For example, if the flow rate is Q for say 3 bar absolute intake pressure and 12 bar absolute discharge pressure, it becomes approximately 2 Q if the conditions become 6 and 24 bar, whereas precisely the mass flow taken in approximately doubles in this second case.

If now the restriction has been chosen to allow the flow rate in the conditions 3–12 bar, it remains appropriate for the conditions 6–24 bar ; thus, if it is adequate for a point of a straight line such as 22 to 25, then it is also adequate for any other point of that line.

By contrast, this phenomenon is not true any more if the compression ratio varies.

When this ratio increases and progressively changes from line 22 to line 25, the ratio between the flow rate through the restriction and the intake flow increases.

Thus, if the restriction is appropriate for satisfying e.g. the conditions of line 23, the flow rate through the restriction would be much too high for the conditions of line 25 and a great quantity of gas would leave with the liquid, cancelling the interest of the economiser. The volume of gas beyond which the losses become too large to remain acceptable has been found to be around 20% ; the restriction is dimensioned so that, for the highest pressure ratios which may occur in the compressor in stable operating conditions (transient conditions may lead to higher pressure ratios), the flow rate generated by the pressure between economiser and intake be equal to the mass flow taken in by the compressor.

The consequence should then be that, for lower pressure ratios, the centrifugal device should foul, and that liquid leave with the gas toward the compressor economiser hole, which would also be highly detrimental.

But it has been noticed that when this occurs, as the liquid ring becomes thicker, an additional hydrostatic pressure is created which comes in addition to the difference of pressure between economiser and intake, and forces the flow to coincide again with the intake flow of the compressor.

For example, a refrigerating system operates with refrigerant fluid called "Refrigerant 22" while the extreme conditions are : minimum intake pressure 2 bar, maximum intake pressure 8 bar, minimum pressure ratio during stable operation 2.5, maximum pressure ratio during stable operation 6. The ratio between the volume flow rate of the restriction (the length of which in the test hereafter is approximately 100 times the diameter) and the compressor volume varies from 1 for pressure ratio 6 to approximately 0.5 for 2.5. But it becomes 1 again if one creates, thanks to the centrifugal device, an additional pressure of less than 1 bar -in the case where the intake pressure is 3 bar- and around 2.5 bar when the intake pressure is 6 bar. Such additional pressures are easily produced by a centrifugal device.

In particular, in screw compressors the screw of which is driven directly by an electric motor rotating at 3000 or 3600 rpm and where the economiser rotor is mounted on the same shaft, a centrifugal device with the same diameter as the screw creates at its periphery centrifugal accelerations exceeding 1000 g (g being the gravitational acceleration), whereby a ring thickness of 2 cm generates a hydrostatic pressure exceeding 2 bar.

What is claimed is:

1. A refrigeration or the like system comprising at least a compressor (1) having a discharge orifice connected to a condenser (2) communicating with an expansion valve (3) connected to a centrifugal economiser (7), the latter being connected via a gas conduit to an economiser orifice (13) of the compressor and via a liquid conduit to an evaporator (18) connected to an intake orifice of said compressor, the centrifugal economiser comprising a rotor (8) mounted for rotation in a stationary casing (6) provided with three orifices respectively connected to the expansion valve, to the economiser orifice and to the evaporator, and wherein the liquid conduit has means defining a fixed orifice, (17); the size of which is selected so that, for the highest pressure ratios sustained by the system during permanent operation, the flow of gas through the liquid conduit does not exceed substantially 20% of the flow of gas returning to the economiser orifice.

* * * * *